US008155539B2

(12) United States Patent
Kawasaki et al.

(10) Patent No.: US 8,155,539 B2
(45) Date of Patent: Apr. 10, 2012

(54) IMAGE FORMING APPARATUS WITH ELECTROSTATIC CAPACITY DETECTION

(75) Inventors: Shuhei Kawasaki, Mishima (JP); Motoki Adachi, Ashigarakami-gun (JP); Yuji Kawaguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 378 days.

(21) Appl. No.: 12/476,593

(22) Filed: Jun. 2, 2009

(65) Prior Publication Data

US 2009/0317138 A1 Dec. 24, 2009

(30) Foreign Application Priority Data

Jun. 20, 2008 (JP) ..... 2008-161528
May 1, 2009 (JP) ..... 2009-112020

(51) Int. Cl.
*G03G 15/08* (2006.01)

(52) U.S. Cl. ..... 399/27; 399/227; 399/281

(58) Field of Classification Search ..... 399/27, 399/227, 281
See application file for complete search history.

(56) References Cited

U.S. PATENT DOCUMENTS

| | | | | |
|---|---|---|---|---|
| 5,258,819 | A * | 11/1993 | Kimura et al. | 399/227 X |
| 6,421,516 | B1 | 7/2002 | Kinoshita et al. | 399/254 |
| 6,963,707 | B2 | 11/2005 | Kinoshita et al. | 399/129 |
| 7,068,966 | B2 | 6/2006 | Shinohara et al. | 399/227 |
| 7,158,740 | B2 | 1/2007 | Shinohara et al. | 399/227 |
| 7,286,788 | B2 | 10/2007 | Kinoshita et al. | 399/129 |
| 7,444,089 | B2 * | 10/2008 | Watanabe et al. | 399/27 |
| 7,583,916 | B2 | 9/2009 | Ogata et al. | 399/254 |
| 7,853,179 | B2 * | 12/2010 | Nishi | 399/227 |
| 2005/0008402 | A1 * | 1/2005 | Mizutani et al. | 399/281 |
| 2006/0291873 | A1 * | 12/2006 | Shishikura et al. | 399/27 X |
| 2006/0291879 | A1 * | 12/2006 | Tsukada et al. | 399/27 |
| 2008/0193171 | A1 | 8/2008 | Adachi et al. | 399/284 |
| 2008/0267641 | A1 * | 10/2008 | Konishi et al. | 399/27 |
| 2009/0003850 | A1 * | 1/2009 | Yamamoto et al. | 399/27 |

FOREIGN PATENT DOCUMENTS

| | | | |
|---|---|---|---|
| JP | 4-234777 | A | 8/1992 |
| JP | 2004-85901 | A | 3/2004 |

OTHER PUBLICATIONS

Notice of Preliminary Rejection dated Dec. 13, 2010, in counterpart Korean Application No. 10-2009-0054962.
Notice of Allowance dated Sep. 28, 2011, in Korean Application No. 10-2009-0054962.

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a rotary for changing an attitude of a developing device to a first attitude in which developer in a developer accommodating chamber is feedable to a developer feeding member and to a second attitude in which the developer having been located above a nip between the developer feeding member and a developing roller drops from the nip. In the image attitude of the developing device, an electrostatic latent image is developed. In the second attitude of the developing device, detection of a remaining amount of the developer is carried out.

4 Claims, 9 Drawing Sheets

IMAGE FORMING APPARATUS WITH ELECTROSTATIC CAPACITY DETECTION

FIELD OF THE INVENTION AND RELATED ART

The present invention relates to an image forming apparatus, such as an image forming apparatus of an electrophotographic type or an electrostatic recording type, in which an image bearing member such as an electrophotographic photosensitive member or an electrostatic recording dielectric member for bearing an electrostatic latent image at its surface and a developing means for developing the electrostatic latent image with developer are provided and an image is formed on a recording material.

The applicant has proposed a method of detecting a remaining amount of developer (hereinafter referred to as toner) in a developing device as the developing means (Japanese Laid-Open Patent Application No. Hei 4-234777).

In this method, a remaining toner amount in the developing device including a toner carrying member for developing an electrostatic latent image by feeding the toner to an image bearing member and a toner feeding member for feeding the toner to the toner carrying member is detected. More specifically, a toner application member for applying the toner onto the toner carrying member is proposed on an electroconductive supporting member and an AC voltage is applied to the toner carrying member by a developing bias power source. Then, a voltage induced on the electroconductive supporting member is detected to determine the remaining toner amount. That is, the voltage induced on the electroconductive supporting member depends on electrostatic capacity between the toner carrying member and the electroconductive supporting member. The electrostatic capacity between the toner carrying member and the electroconductive supporting member is different between a state in which the toner is sufficiently present in the developing device and fills a gap between the electroconductive supporting member and a state in which the amount of the toner in the gap between the toner carrying member and the electroconductive supporting member is decreased. For this reason, the voltage indicated on the electroconductive supporting member is also different. By utilizing this phenomenon, the remaining toner amount is detected. According to this method, it is possible to realize remaining toner amount detection without particularly requiring a space.

The present invention is a further improvement in the above-described prior-art method. That is, in the above-described remaining toner amount detection, it has been found that variation in resultant electrostatic capacity can occur in the case where a density of the toner in the developing device is changed although the toner in the developing device is not consumed.

Generally, during image formation, the toner in the developing device is sufficiently stirred and circulated by rotation of the toner carrying member, rotation of the toner feeding member, and the like. On the other hand, in the case where the developing device is left standing after completion of the image formation, the toner in the developing device is tightly deposited vertically toward a lower portion of a toner container by its own weight. As a result, the toner density between the toner carrying member and the electroconductive supporting member of the toner application member is changed, so that a value of the resultant electrostatic capacity can cause variation.

When this problem is intended to be solved, before the remaining toner amount detection, an operation in which the developing device is rotationally driven in advance to stir the toner in the developing device so as to uniformize the toner density is required. A certain time is required for every remaining toner amount detection, thus leading to a lowering in throughput of the image forming apparatus. Further, by the rotational drive of the developing device, abrasion or deterioration of the developing device was accelerated, so that there was a possibility of an adverse influence on a lifetime of the developing device.

SUMMARY OF THE INVENTION

The present invention intends to further improve accuracy with respect to remaining toner amount detection in the above-described prior-art method.

A principal object of the present invention is to provide an image forming apparatus capable of stably performing the remaining toner amount detection in a developing means with high accuracy by eliminating an occurrence of a variation in detected electrostatic capacity due to a change in toner density, i.e., irrespective of a use environment or a standing state of the developing means.

Another object of the present invention is to provide an image forming apparatus capable of stably performing the remaining toner amount detection, with high accuracy, utilizing an antenna type electrostatic capacity change detection.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described more specifically in an exemplary manner. However, dimensions, materials, shapes, and relative arrangements of constituents elements described in the following embodiments may appropriately be changed depending on constitutions and various conditions for apparatuses or devices to which the present invention is to be applied. Therefore, it should be understood that the present invention is not limited to those specifically described in the following embodiments.

[Embodiment 1]

General Structure of Image Forming Apparatus

Figure 1:
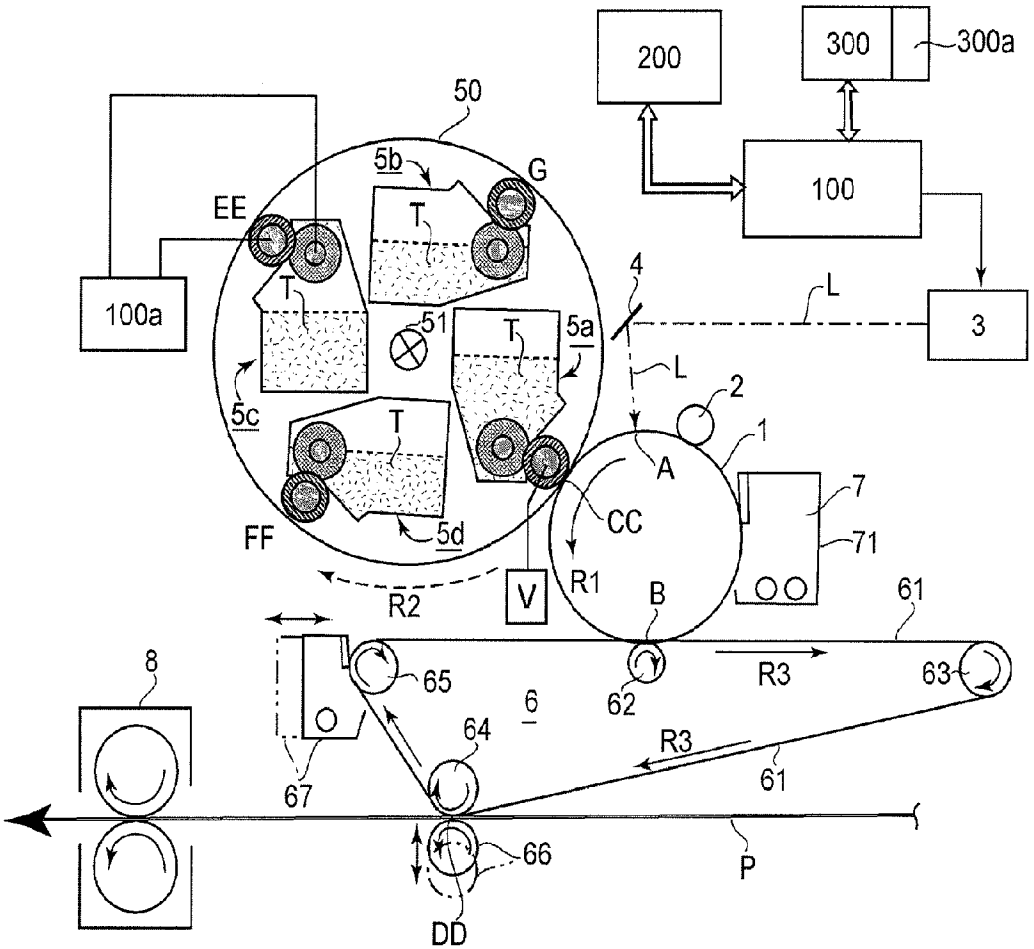
FIG. 1 is a schematic structural view of an image forming apparatus of Embodiment 1.

FIG. 1 is a schematic structural view of an image forming apparatus of this embodiment. This image forming apparatus is a four-color based full-color image forming apparatus using an electrophotographic process. The image forming apparatus effects image formation on a sheet-like recording material P as a recording medium on the basis of an electric image signal inputted from a host device 200, such as an image reader (an original image reading device), a personal computer, or a facsimile machine, into a controller portion (a control means: CPU) 100. The controller portion 100 gives and receives various pieces of electrical information between the controller portion 100 and the host device 200 or an operation portion 300 of the image forming apparatus and effects centralized control of an image forming operation of the image forming apparatus in accordance with a predetermined control program or a reference table.

The image forming apparatus includes a rotatable drum type electrophotographic photosensitive member 1 as an image bearing member for bearing an electrostatic latent image on its surface (hereinafter referred to as a drum) and includes a charging means 2, an image exposure means 3, developing means 5 (5*a*, 5*b*, 5*c*, 5*d*), a transfer means 6, and a drum cleaning means 7 as process means acting on the drum 1.

The drum 1 is rotationally driven about an axis of the drum 1 at a predetermined speed in a counterclockwise direction indicated by an arrow R1. The charging means 2 is a means for electrically charging the surface of the drum 1 uniformly to a predetermined polarity (negative in this embodiment) and a predetermined potential and in this embodiment, a contact charging roller is used as the charging means 2. The image exposure means 3 is a means for forming an electrostatic latent image on the surface of the drum 1 and, in this embodiment, a laser scanner unit is used as the image exposure means 3. The unit 3 subjects the electrically charged surface of the drum 1 to scanning exposure at an exposure portion A through a reflection mirror 4 by outputting laser light L modulated correspondingly to image information for each of colors inputted from the host device 200 into the controller portion 100. As a result, the electrostatic latent image is formed on the surface of the drum 1. In this embodiment, as an electrostatic latent image forming system, an image exposure system for exposing the charged drum surface to the light correspondingly to the image information.

The developing means 5 is a means for visualizing the electrostatic latent image formed on the drum surface into a developer image (a toner image). In the image forming apparatus of this embodiment, a plurality of developing devices as the developing means is provided. That is, first to fourth developing devices 5 (5*a*, 5*b*, 5*c*, 5*d*: developing cartridges) are provided. These developing devices are held in a rotary 50 as a developing device holding member (holding unit). The rotary 50 is rotatable with indexing about a center shaft 51 as a rotational center. The respective developing devices 5*a*, 5*b*, 5*c*, and 5*d* are detachably mounted to predetermined mounting portions (developing device mounting portions) so that the respective developing devices 5*a*, 5*b*, 5*c* and 5*d* are indexed at 90 degree intervals with respect to a rotational direction of the rotary 50. The rotary 50 is rotated with the indexing at 90 degree intervals in a clockwise direction indicated by an arrow R2 by a driving means (a motor or the like: not shown) controlled by the controller portion 100. As a result, the first to fourth developing devices 5*a*, 5*b*, 5*c* and 5*d* are successively switched and moved to a developing position CC in which an associated developing device opposes the drum 1 in a predetermined manner and the electrostatic latent image formed on the surface of the drum 1 is developed into a toner image.

Here, a position of the developing device 5, mounted to the rotary 50, moved to the developing position CC in which the developing device 5 opposes the drum 1 in the predetermined manner is referred to as a position CC. Further, the position of the developing device 5 moved from the position CC by 90 degree rotation of the rotary 50 is referred to as a position FF. Further, the position of the developing device 5 moved from the position FF by further 90 degree rotation of the rotary 50 (180 degree rotation from the position CC) is referred to as a position EE. Further, the position of the developing device 5 moved from the position EE by further 90 degree rotation of the rotary 50 (270 degree rotation from the position CC) is referred to as a position G.

In this embodiment, each of the first to fourth developing devices 5*a*, 5*b*, 5*c* and 5*d* is a reverse-developing device of a contact development type using negatively chargeable non-magnetic toner as developer T. In this embodiment, the first developing device 5*a* is a yellow developing device accommodating yellow toner (Y) in a developer accommodating chamber. The second developing device 5*b* is a magenta developing device accommodating magenta toner (M) in a developer acting chamber. This third developing device 5*c* is a cyan developing device accommodating cyan toner (C) in a developer accommodating chamber. The fourth developing device 5*d* is a black developing device accommodating black toner (Bk) in a developer accommodating chamber.

The transfer means 6 is a means for transferring the toner image formed on the surface of the drum 1 onto the recording material and in this embodiment, an intermediary transfer belt unit is used as the transfer means 6. This unit 6 includes an endless intermediary transfer belt 61, as an intermediary transfer member (a first recording medium), formed of a dielectric member and having flexibility (hereinafter referred to as a belt). The unit 6 further includes a primary transfer roller 62, a belt driving roller 63, a secondary transfer opposite roller 64, and a tension roller 65 around which the belt 61 is stretched. The primary transfer roller 62 press-contacts the belt 61 against the drum 1. A contact portion between the drum 1 and the belt 61 is a primary transfer nip B. To the secondary transfer opposite roller 64, a secondary transfer roller 66 is provided oppositely through the stretched belt 61 portion. The secondary transfer roller 66 is positionally-movable, by a swing mechanism (not shown), between an operating position in which the secondary transfer roller 66 contacts the belt 61 contacting the secondary transfer opposite roller 64 and a non-operating position in which the secondary transfer roller 66 is moved away from the surface of the belt 61. The secondary transfer roller 66 is normally held at the non-operating position and is then moved to the operating position with predetermined control timing. In the state in which the secondary transfer roller 66 is moved to the operating position, a contact portion between the secondary transfer roller 66 and the belt 61 is a secondary transfer nip D. To the tension roller 65, a belt cleaning means 67 for cleaning the surface of the belt 61 is provided oppositely through the stretched belt 61 portion. This belt cleaning means 67 is positionally-movable, by a swing mechanism (not shown), between an operating position in which a cleaning member contacts the surface of the belt 61 and a non-operating position in which the cleaning member is moved away from the surface of the belt 61. The belt cleaning means 67 is normally held at the non-operating position and is then moved to the operating position with predetermined control timing.

The drum cleaning means 7 is a means for removing primary transfer residual toner from the drum 1 surface after the primary transfer of the toner image onto the belt 61 and employs a cleaning blade. The toner removed from the drum surface is collected in a cleaner container 71.

The controller portion 100 actuates a main motor (not shown) when an image forming start signal is inputted. As a result, the drum 1 is rotationally driven at a predetermined speed in the counter-clockwise direction indicated by the arrow R1. Further, the rotary 50 is rotated with the indexing so as to place the first developing device 5*a* in the state in which the first developing device 5*a* is moved to the position CC. Then, to the first developing device 5*a*, a driving force is transmitted. Further, a predetermined develop bias is applied. The laser scanner unit 3 is driven. The belt 61 is rotationally driven at a speed corresponding to the speed of the drum 1 in the clockwise direction indicated by the arrow R3 (in the same direction as the drum 1 at their contact portion) The secondary transfer roller 66 and the belt cleaning means 67 are moved to and held at their non-operating positions, respectively, in which the roller 66 and the means 67 are moved away from the belt 61. The predetermined charging bias is applied to the charging roller 2. As a result, the surface of the rotating drum 1 is electrically charged uniformly to the predetermined polarity (negative in this embodiment) and the predetermined potential. The laser light L modulated correspondingly to a Y color component image signal for a full-color image is emitted from the laser scanner unit 3 to subject the drum surface to scanning exposure thereto. As a result, an electrostatic latent image corresponding to the Y color component image is formed on the drum surface. The electrostatic latent image is developed into a Y color toner image (developer image) by the first developing device 5*a* located at the position CC. In this embodiment, the electrostatic latent image is reversely developed with the negatively charged toner having the same polarity as the charge polarity (negative) of the drum 1. The Y color toner image is primary-transferred onto the surface of the belt 61 in the primary transfer nip B. To the primary transfer roller 62, the primary transfer bias of a predetermined potential having an opposite polarity (positive) to the toner charge polarity is applied with predetermined control timing. The drum surface after the primary transfer is cleaned by the cleaning means 7.

When the primary transfer of the Y color toner image onto the belt 61 is completed, the rotary 50 is intermittently rotated by 90 degrees in the clockwise direction. As a result, the second developing device 5*b* is now moved to the position CC. Then, steps of charging, exposure, and development for forming the M color toner image, corresponding to the M color component image for the full-color image, on the drum 1 are performed. The M color toner image is primary-transferred onto the Y color toner image which has already been transferred onto the belt 61 in a predetermined alignment state in a superposition manner.

When the primary transfer of the M color toner image onto the belt 61 is completed, the rotary 50 is intermittently rotated by further 90 degrees in the clockwise direction. As a result, the third developing device 5*c* is now moved to the position CC. Then, steps of charging, exposure, and development for forming the C color toner image, corresponding to the C color component image for the full-color image, on the drum 1 are performed. The C color toner image is primary-transferred onto the Y and M color toner images which have already been transferred onto the belt 61 in a predetermined alignment state in a superposition manner.

When the primary transfer of the C color toner image onto the belt 61 is completed, the rotary 50 is intermittently rotated by further 90 degrees in the clockwise direction. As a result, the fourth developing device 5*d* is now moved to the position CC. Then, steps of charging, exposure, and development for forming the Bk color toner image, corresponding to the Bk color component image for the full-color image, on the drum 1 are performed. The Bk color toner image is primary-transferred onto the Y, M and C color toner images which have already been transferred onto the belt 61 in a predetermined alignment state in a superposition manner.

In this manner, on the belt 61, unfixed full-color toner images of Y, M, C and Bk are synthetically formed.

That is, by rotating the rotary 50 with the indexing by the driving means, one developing device is moved to the position CC in which the developing device opposes the drum 1 in the predetermined manner and the electrostatic latent image formed on the drum 1 is developed into the toner image by the developing device. This operation is successively performed in a switching manner with respect to the plurality of the developing devices to carry out formation of the full-color toner images on the belt 61.

Incidentally, the order of the colors of the color toner images successively formed on the drum 1 is not limited to the color order of Y, M, C and Bk as in this embodiment but may also be appropriately changed.

The secondary transfer roller 66 is moved to the operating position in which the secondary transfer roller 66 contacts the belt 61 before leading edges of the unfixed four-color based full-color toner images formed on the belt 61 reach the position of the secondary transfer roller 66. Further, the belt cleaning means 67 is also moved to the operating position for the belt 61.

With predetermined control timing, the sheet-like recording material P as a second recording medium is fed from a recording material feeding portion (not shown) after being separated one by one. The recording material P is guided, by a registration roller unit (not shown), into the secondary transfer nip DD which is the contact portion between the secondary transfer roller 66 and the belt 61. To the secondary transfer roller 66, the secondary transfer bias of the predetermined potential having the opposite polarity (positive) to the toner charge polarity is applied. As a result, the four color toner images superposed on the belt 61 are secondary-transferred collectively onto the recording material P during a process in which the recording material P is nip-conveyed in the secondary transfer nip DD.

The recording material P is separated from the surface of the belt 61 and guided into a fixing unit 8, in which the recording material P is heated and pressed in a fixing nip. As a result, the respective color toner images is fixed (melted and color-mixed) on the recording material P. Then, the recording material P comes out of the fixing unit 8 and is discharged to a sheet discharge portion (not shown) as a full color image-formed product.

Secondary transfer residual toner remaining on the surface of the belt 61 after the separation of the recording material P is removed by the belt cleaning means 67.

The controller portion 100 places the image forming apparatus in a stand-by state after an image forming job on a single sheet or a plurality of successive sheets is completed, thus awaiting input of a subsequent image forming start signal.

That is, the drive of the drum 1, the laser scanner unit 3, the belt 61, and the like is stopped. The secondary transfer roller 66 and the belt cleaning means 67 are moved to their non-operating positions.

In the case of a monochromatic image forming mode, only image formation using the fourth developing device 5*d* for black is carried out. The controller portion 100 places the image forming apparatus in the stand-by state after an monochromatic image forming job on a single sheet or a plurality of successive sheets is completed, thus awaiting input of a subsequent image forming start signal.

(Developing Device 5)

In this embodiment, the first to fourth developing devices 5*a*, 5*b*, 5*c* and 5*d* each as the develop means are different in color of the developers (toners) accommodated therein but have the same constitution.

Figure 2:
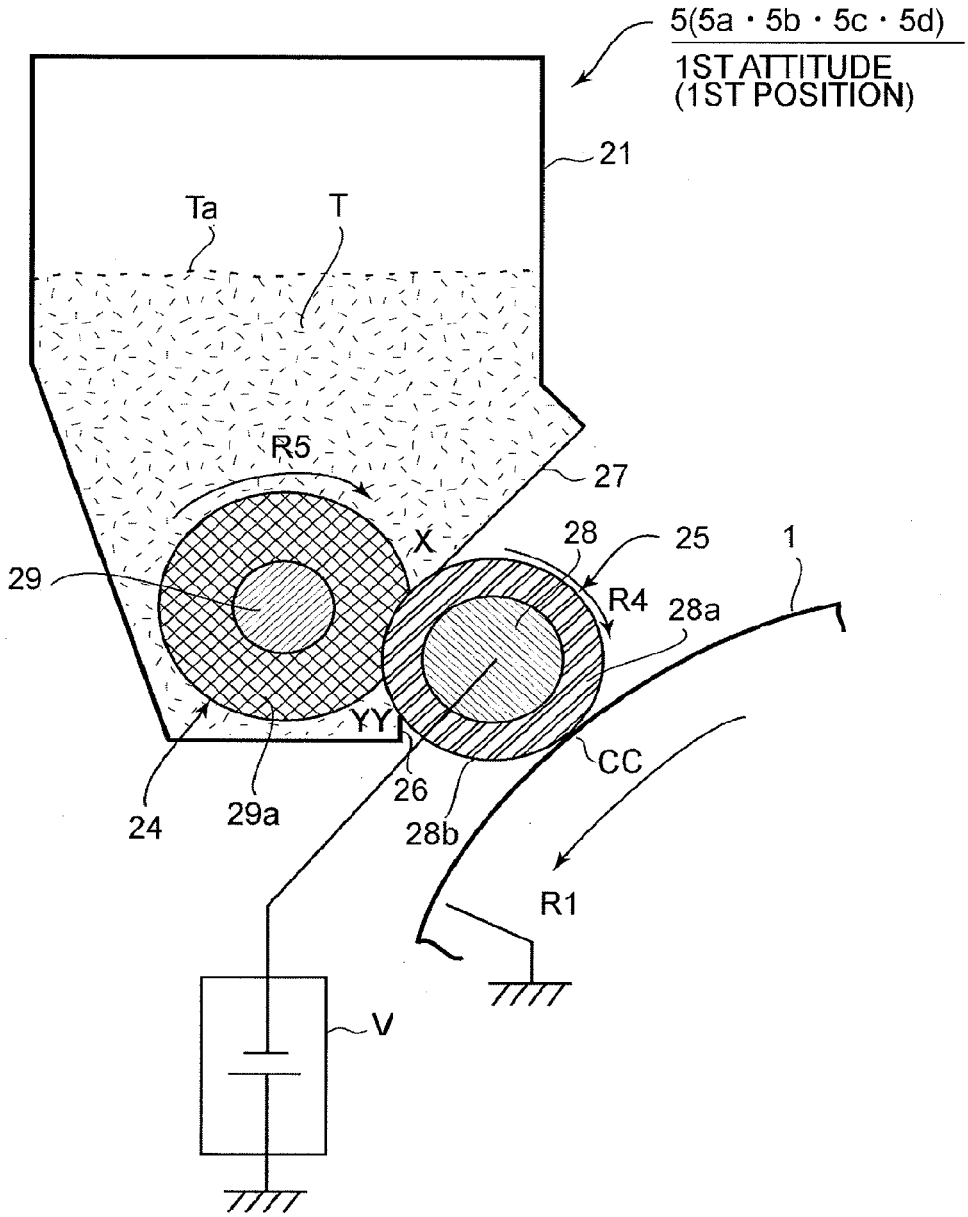
FIG. 2 is an enlarged schematic view of a developing device in a first position.

FIG. 2 is an enlarged schematic view of the developing device 5 at the position C. The developing device 5 includes the developer container 21 as the developer accommodating chamber accommodating the toner T therein, the developing roller 25 as the developer carrying member for developing the electrostatic latent image formed on the drum 1, and the application roller 24 as the developer feeding member for feeding the toner in contact with the developing roller 25. The developing device 5 further includes a regulating blade 27 as a developer layer thickness regulating member for regulating the thickness of the toner layer on the developing roller 25 and a leak prevention seal 26 for preventing the toner from leaking out of a gap between the developing roller 25 and the developer container 21.

The developer container 21 is an enlarged container having a longitudinal direction along the axial direction of the drum 1. The developer container 21 has an opening, at a lower portion thereof, oppositely to the drum 1 along the longitudinal direction of the developer container 21. The developing roller 25 is located in the opening and is disposed in parallel with the developer container 21 with respect to the longitudinal direction of the developer container 21. The developing roller 25 is rotatably supported by the container 21 through bearing members (not shown) mounted on both longitudinal sides of the container 21. The application roller 24 is disposed in the container 21 in parallel to the developing roller 25 on an opposite side from the side on which the developing roller 25 opposes the drum 1. The application roller 24 is rotatably supported by the container 21 through bearing members (not shown) mounted on both longitudinal sides of the container 21.

In this embodiment, the developing roller 25 has a diameter of 13 mm and has a constitution in which around an electroconductive core metal (portion) 28 having a diameter of 8 mm, a base layer 28*a* of a silicone rubber is formed and a surface layer 28*b* of an acrylic-urethane based rubber is coated on the base layer 28*a*. The developing roller 25 has a volume resistivity of $10^4$ to $10^{12}$ Ω·cm.

The application roller 24 is an urethane sponge roller, having a diameter of 15 mm, prepared by providing an urethane sponge layer 29*a* of an open-cell member around an electroconductive core metal (portion) 29 having a diameter of 6 mm. The application roller 24 has a volume resistivity of about $10^4$ to $10^{12}$ Ω·cm. That is, the application roller 24 is constituted by an open-cell member.

A distance between the core metal 28 (also known as a metal core) of the developing roller 25 and the core metal 29 (also known as a metal core) of the application roller 24 (a distance between centers of the core metals 28 and 29) is 13 mm. The urethane sponge layer 29*a* of the application roller 24 is depressed by 1.0 mm by the surface of the developing roller 25.

The regulating blade 27 is a flexible member which is configured to coat the toner applied onto the developing roller 25 in a small thickness by its end portion rubbing against the developing roller 25 and is formed of phosphor bronze, an urethane rubber, or the like. The regulating blade 27 is provided to the container 21 with a base portion thereof fixed to an upper edge portion of the above-described opening.

The leak prevention seal 26 is a flexible member which contacts the developing roller 25 at its end portion and prevents the toner leakage by covering the gap between the lower portion of the developing roller 25 and the developer container 21. The leak prevention seal 26 is provided to the container with a base portion thereof fixed to a lower edge portion of the above-described opening.

The development of the electrostatic latent image formed on the drum 1 by the developing device is performed by moving a predetermined developing device 5 to the position CC (a first position), in which the developing device 5 opposes the drum 1 in the predetermined manner, by the indexing rotation control of the rotary 50 as shown in FIGS. 1 and 2.

In this embodiment, the developing device 5 at the position CC opposes the drum 1 in a standing attitude (a first attitude) with an upward top surface and a downward bottom surface of the developer container 21. The developing roller 25 of this developing device 5 contacts the drum 1. The developing roller 25 develops the electrostatic latent image formed on the drum 1 in the contact state with the drum 1. That is, a so-called contact developing system is employed.

Into the developing device 5 at the position CC, the driving force and the developing bias are inputted from the driving means (not shown) and a power source portion V, respectively, on the image forming apparatus main assembly side during execution of the image formation. The developing roller 25 is rotationally driven at the predetermined speed in the clockwise direction indicated by an arrow R4 in FIG. 2. Therefore, the rotational direction of the developing roller 25 in the same as the rotational direction R1 of the drum 1 at the contact portion between the developing roller 25 and the drum 1. Further, the application roller 24 for feeding the toner to the developing roller 25 in contact with the developing roller 25 is rotationally driven at the predetermined speed in the clockwise direction indicated by the arrow R5. Therefore, the rotational direction of the application roller 24 is opposite from (counter to) the rotational direction R4 of the developing roller 25 at the contact portion between the application roller 24 and the developing roller 25.

Onto the peripheral surface of the rotating developing roller 25, the toner is applied by the application roller 24 and then the applied toner is coated in a thin layer by the regulating blade 27. The thin toner layer is conveyed to the developing position CC by further rotation of the developing roller 25 to face the surface of the drum 1. To the developing roller 25, a predetermined developing bias, i.e., a DC voltage in this embodiment, is applied from a developing bias power source portion V. As a result, the thin toner layer on the peripheral surface of the developing roller 25 is selectively transferred onto the drum surface correspondingly to the electrostatic latent image on the drum surface. Thus, the electrostatic latent image is developed into the toner image. The toner which has not been subjected to the development of the electrostatic latent image is conveyed and returned to the inside of the developer container 21 by subsequent rotation of the developing roller 25. Then, the toner is removed from the surface of the developing roller 25 by the application roller 24 and at the same time, the toner is applied again onto the surface of the developing roller 25 by the application roller 24. This operation is repeated to carry out the development of the electrostatic latent image on the drum surface.

The attitude of the developing device 5 at the position CC is the standing attitude (the first attitude) as described above, so that the toner in the developer container is localized and present at the vertically lower portion of the inside of the developer container 21 where the application roller 24 is provided (i.e., on the container bottom side) by gravitation. A reference symbol Ta represents a toner surface (a developer surface) of the toner T accommodated in the developer container 21. The attitude of this developing device 5 is such an attitude that the toner T is feedable to the application roller 24. By this attitude, it is possible to apply the toner T onto the developing roller 25. Further, the attitude is also such a developable attitude that the toner is present in an area X from the nip (contact nip) between the developing roller 25 and the application roller 24 toward an upstream side of the application roller 24 from the nip with respect to the rotational direction of the application roller 24. The area X is located at a position above the nip between the developing roller 25 and the application roller 24 in the developable attitude (the first position) with respect to the gravitation direction.

During normal image formation, the attitude of the developing device 5 at the position CC which is the developing position is the standing attitude and the toner T in the developer container 21 is localized and present at the vertically lower portion by the gravitation, particularly in a state in which a toner density in the neighborhood of the area X is high. This is because when the toner density in the neighborhood of the area X is lowered during the normal image formation, the toner feeding to the developing roller 25 is insufficient to cause a white void portion or the like on the image. Therefore, during the image formation, the toner may desirably be placed in a dense state in the neighborhood of the area X.

Here, the developing device 5 at the position FF takes such a sideways attitude that the developing roller 25 is located under the application roller 24. Further, the developing device 5 at the position EE is changed in attitude from the standing attitude at the position CC to an inverted attitude (opposite attitude) in which the developing device 5 is turned upside down. Further, the developing device 5 at the position G takes such a sideways attitude that the developing roller 25 is located on the application roller 24.

With the use of the first to fourth developing devices 5 (5*a*, 5*b*, 5*c* and 5*d*) for the image formation, each of the toners accommodated in the respective developing devices is consumed. Therefore, a remaining amount detecting means (a remaining amount detecting circuit portion) for detecting the remaining toner amount in each of the developing devices is provided. Then, the detected remaining amount value is compared with a preset threshold value for advance notice or warning of the developing device lifetime. With respect to the developing device in which the remaining toner amount value is decreased to a value less than the threshold value, at a display portion 300*a* of the operating portion 300, an advance notice of the lifetime or the warning of the lifetime is displayed. As a result, the operator is urged to prepare a developing device for exchange of the developing device, so that a quality of an output image is retained. The exchange of the old for the new is performed by removing the used developing device from the developing device mounting portion of the rotary 50 in a predetermined procedure and then mounting a new developing device to the developing device mounting portion in a predetermined procedure.

Figure 3:
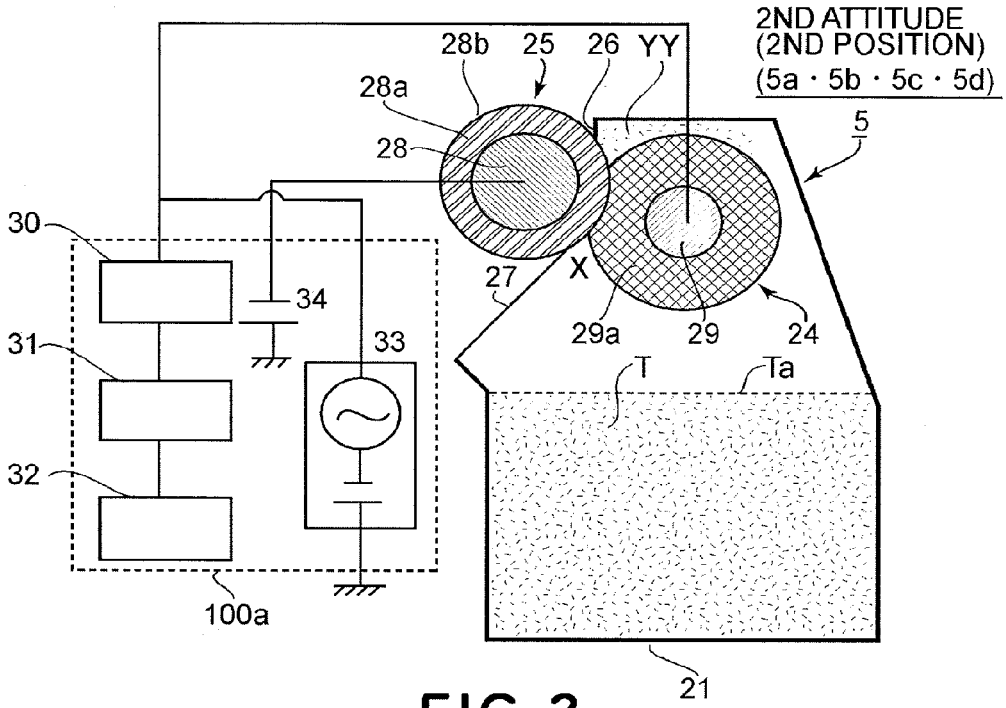
FIG. 3 is an enlarged schematic view of the developing device in a second position.

In this embodiment, the remaining toner amount detection of the developing device is carried out in a state in which the attitude of the developing device 5 is changed from the first attitude to the second attitude. The first attitude of the developing device 5 is a developable attitude with respect to the drum 1 and is also an attitude in which the toner T is feedable to the application roller 24. The second attitude of the developing device 5 is an attitude in which the attitude of the developing device 5 is changed from the first attitude and the toner is returned from the application roller 24 to the developer container 21. The first attitude of the developing device 5 is, in this embodiment, that at the position CC (the first position). The second attitude is, in this embodiment, that at the position EE (the second position) (FIG. 3).

With respect to the remaining toner amount detection of the developing device changed in attitude to the second attitude, in this embodiment, an AC bias is applied to the electroconductive core metal 29 of the application roller 24 by the remaining amount detecting means 100*a*. Then, from a voltage and electrostatic capacity induced in the electroconductive core metal 28 of the developing roller 25, the remaining amount detection of the toner in the developer container 21. Here, the "electrostatic capacity" refers to that between the application roller 24 and the developing roller 25.

A fundamental principle of the remaining toner amount detection will be described. The application roller 24 in this embodiment is provided with a foam layer at its surface. Specifically, the urethane sponge layer 29*a* of the open-cell member is provided. The application roller 24 has such a feature that the amount of the toner which can be held in the sponge layer varies depending on a degree of optimization of a physical value, of the urethane sponge layer 29*a* of the open-cell member, which is called an airflow amount. The physical property, i.e., the airflow amount refers to an amount of air, per unit time, passing through a cell opening at the surface of the urethane sponge layer of the open-cell member and cells in the sponge layer. That is, the airflow amount is liable to be decreased with a smaller surface cell and a smaller and denser inner cell structure. On the other hand, the airflow amount is liable to be increased with a larger surface cell and a larger inner cell structure.

Figure 4:
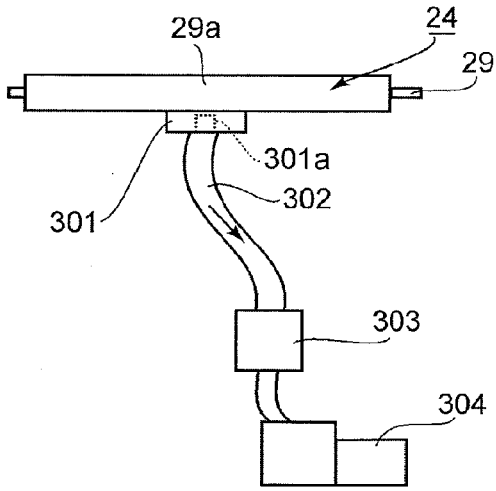
FIG. 4 is a schematic view for illustrating an airflow amount measuring method of an application roller.

For this reason, by the change in airflow amount, the amount of the toner holdable in the sponge is changed. Here, a measuring method of the above-described airflow amount will be described. FIG. 4 is a schematic view of a model to explain the airflow amount measuring method. A hole portion of an acrylic plate 301 provided with a hole 301*a* of 10 mm in diameter is brought into contact with the surface of the urethane sponge layer 29*a* of the application roller 24. To the acrylic plate 301, a hose 302 having a diameter larger than that of the hole 301*a* is connected. Then, the airflow amount when the air is sucked by a commercially available pump 304 is measured by an airflow amount measuring device 303 ("KZ Type Air Permeability Tester", mfd. by DAIEI KAGAKU SEIKI MFG. Co., Ltd.). The suction amount of the pump 304 is 10.8 liter/min in a state of the absence of the application roller 24. According to an experiment by the present inventors, in the image forming apparatus of this embodiment, the airflow amount of the urethane sponge layer of the open-cell member to be adapted was preferably 2 liter/min or more.

Figure 5:
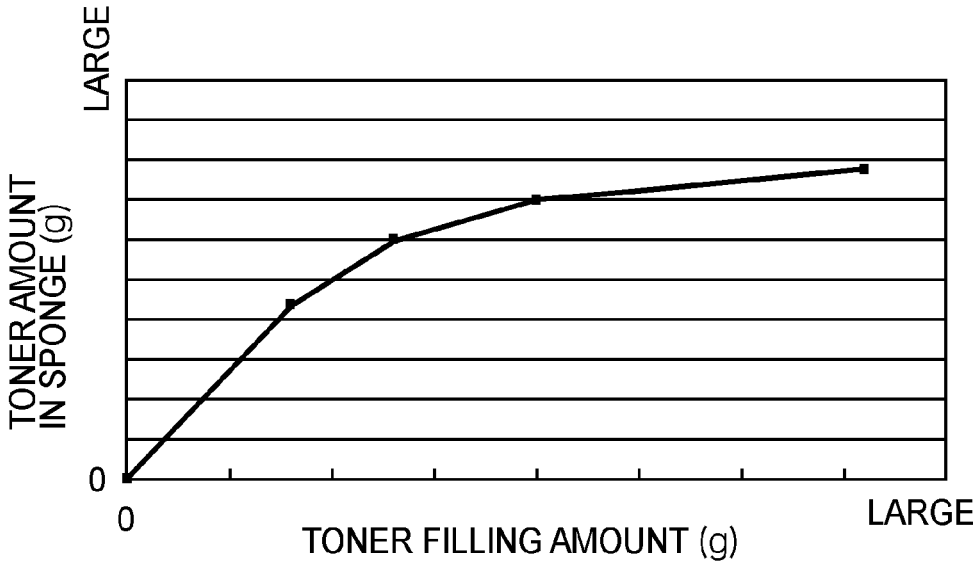
FIG. 5 is a graph showing a relationship between a toner filling amount in a developing device and a toner amount in a sponge of the application roller.

In the case where the application roller 24 subjected to the optimization of the airflow amount in the above-described manner is used, a change in toner amount between in the sponge layer of the application roller 24 and in the developer container is shown in FIG. 5. As shown in FIG. 5, it is found that there is a tendency of the toner amount in the sponge layer of the application roller 24 to decrease with a decreasing toner amount in the developer container. From this result, it is found that there is a correlation between the amount of the toner held inside the sponge layer of the application roller 24 and a total amount of the toner in the developer container.

Figure 6:
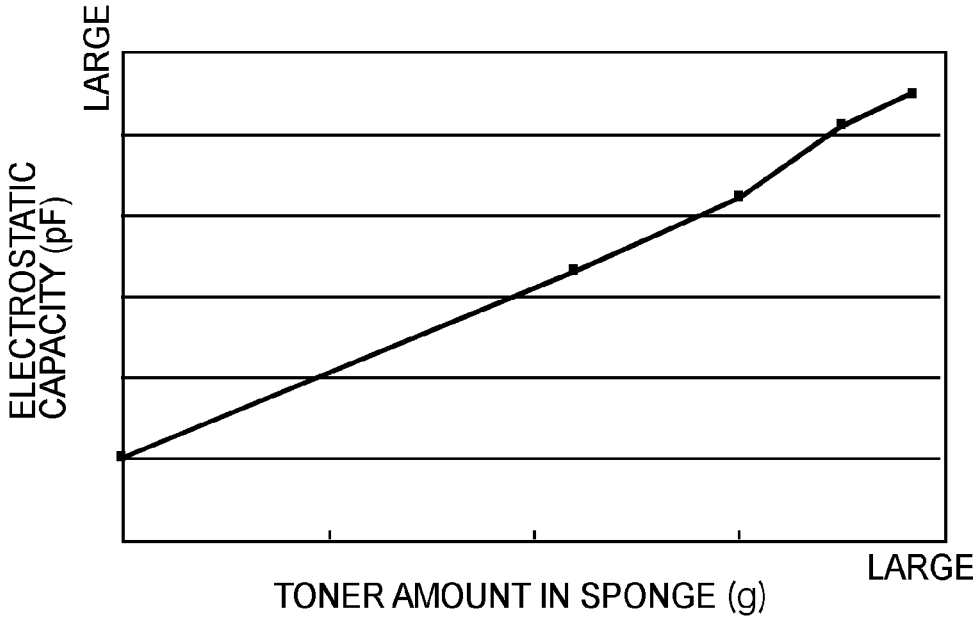
FIG. 6 is a graph showing a relationship between the toner amount in the sponge of the application roller and electrostatic capacity.

Further, the electrostatic capacity between the application roller 24 and the developing roller 25 was measured to obtain a change thereof with the toner amount in the sponge layer. The result is shown in FIG. 6. The electrostatic capacity was measured by an LCR meter ("ZM2354", mfd. by NF Corporation). As shown in FIG. 6, the toner amount in the sponge layer and the electrostatic capacity provide a linear relationship. From this result, it is found that there is a correlation between the amount of the toner held inside the sponge layer of the application roller 24 and the electrostatic capacity between the application roller 24 and the developing roller 25. That is, by measuring the electrostatic capacity between the application roller 24 and the developing roller 25, it is possible to estimate the amount of the toner in the developer container 21.

However, when excessive toner is present around the application roller 24 during the measurement of the electrostatic capacity between the application roller 24 and the developing roller 25, the electrostatic capacity is changed in some cases. This is because when the toner is present in a large amount in the neighborhood of the application roller 24, the electrostatic capacity corresponding to a toner amount move than the amount of the toner contained in the sponge layer of the application roller 24 is detected. For this reason, in order to accurately estimate the amount of the toner present only inside the sponge layer of the application roller 24, it is preferable that the toner is not present in the neighborhood of the application roller 24.

Therefore, the remaining toner amount detection by measuring the electrostatic capacity between the application roller 24 and the developing roller 25 of the developing device 5 is carried out after the attitude of the developing device 5 is changed from the first attitude at the first position to the second attitude at the second position. The attitude of the developing device 5 at the first position is the developing attitude with respect to the drum 1 and is the attitude in which the toner is present in the area X located on the upstream side of the nip between the application roller 24 and the developing roller 25 with respect to the rotational direction of the application roller 24. The attitude of the developing device 5 at the second position is the attitude in which the toner T is dropped from the area X described above by changing the developing device attitude from the first position attitude. That is, at the second position, the developing device 5 takes the attitude in which the toner T located in the area X above the nip between the application roller 24 and the developing roller 25 at the first position with respect to the gravitation direction is dropped from the nip.

In this embodiment, the position CC shown in FIG. 1 is the first position, and the position EE shown in FIG. 1 is the second position. Further, the developing device located at the position EE is subjected to the remaining toner amount detection by the remaining amount detecting means 100*a* (a detecting means for detecting the electrostatic capacity between the core metal portion 29 of the application roller 24 and the developing roller 25).

The attitude of the developing device 5 located at the first position CC as the developing position is the standing attitude, whereas the attitude of the developing device 5 located at the second position EE is changed to the inverse attitude in which the developer container 21 is turned upside down. In this inverse attitude of the developing device 5, there is substantially no toner around the application roller 24 as shown in FIG. 3. At the second position E, the toner surface Ta of the toner T accommodated in the developer container 21 does not reach the application roller 24. In this state, the remaining toner amount detection of the developing device 5 by the remaining amount detecting means 100*a* is carried out.

The developing device at the second position EE during the remaining toner amount detection will be described with reference to FIG. 3. The developing device 5 is rotated from the position CC to the position EE by the rotation of the rotary 50 after the image formation, whereby the toner in the developer container 21 of the developing device 5 turned upside down is shaken and dropped down toward the top surface side (at the first position). For this reason, it is possible to obtain the electrostatic capacity corresponding to the amount of the toner present only inside the sponge layer of the application roller 24 without being utterly affected by the toner in the neighborhood of the application roller 24 at the second position E.

In this state, the remaining amount detecting means 100*a* applies a bias for detecting the remaining toner amount from a bias power source 33 to the electroconductive core metal 29 of the application roller 24. As the bias for detecting the remaining toner amount, an AC bias having a frequency of 5 kHz and a peak-to-peak voltage Vpp of 200 V is used. In the electroconductive core metal 28 of the developing roller 25, a voltage is induced by the bias for detecting the remaining toner amount and is detected by a detector 30.

Figure 7:
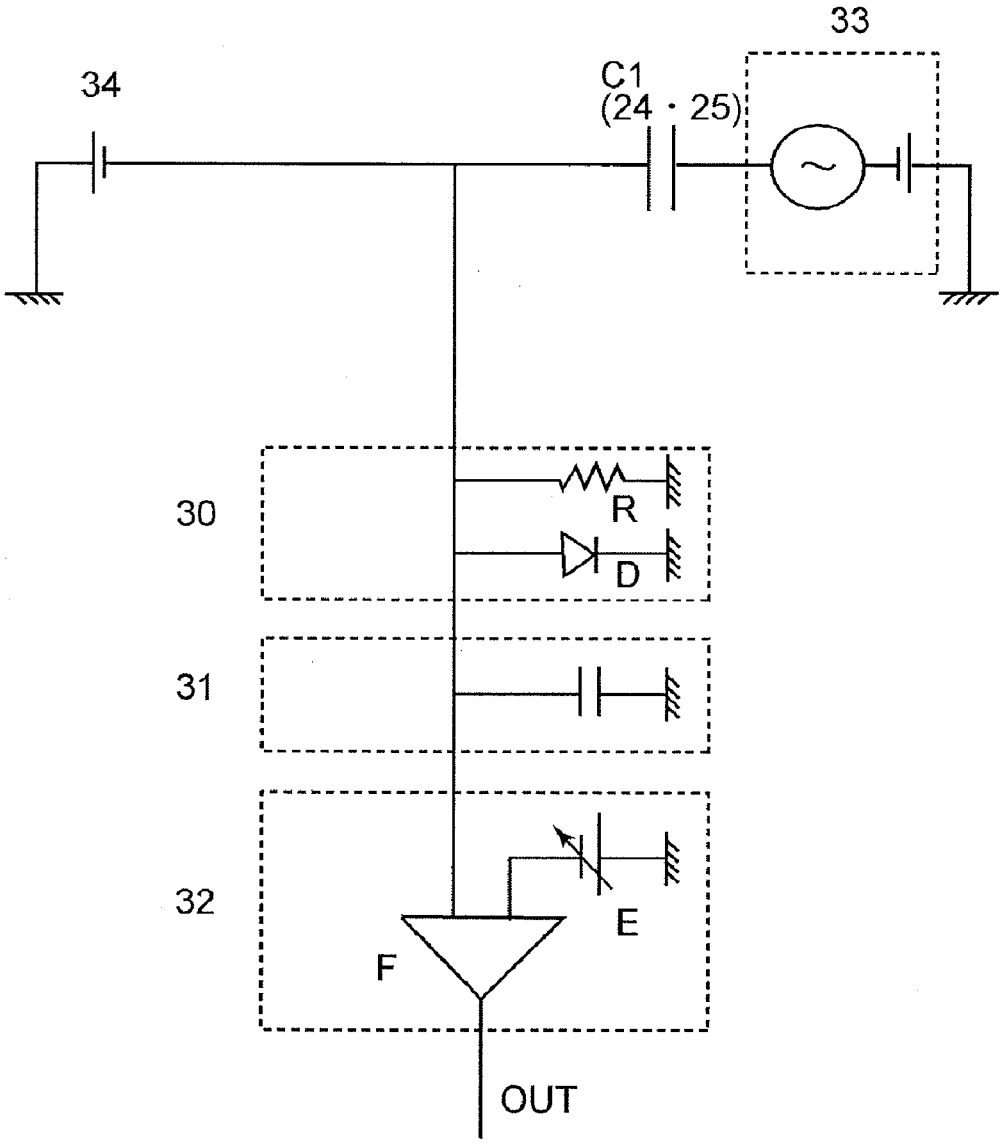
FIG. 7 is a block diagram of a remaining toner amount detection means.

Next, the detector 30, an integrator 31, and a comparator 32 which constitute the remaining amount detecting means 100*a* will be described. FIG. 7 shows an equivalent circuit including the application roller 24 and the developing roller 25 which are represented by a capacitor C1, the detector 30, the integrator 31, the comparator 32, the bias power source 33 for the remaining toner amount detection, and the developing bias power source 34.

From the bias power source 33 for the remaining toner amount detection, the bias for detecting the remaining toner amount which is the AC bias is applied. The detector 30 consists of a resistance R and a diode D. The output of the capacitor C1 is taken out as a voltage for the resistance R and is subjected to half-wave rectification by the diode D. The voltage subjected to the half-wave rectification is integrated by the integrator 31 to be changed into a DC voltage. This DC voltage is compared by the comparator 32 including a comparator F and a reference voltage E. The comparator F compares magnitudes of the output voltage of the integrator 31 and the reference voltage, and the comparator F judges that the toner is present when the output voltage is larger than the reference voltage E and judges that the toner is absent when the output voltage is smaller than the reference voltage E. Therefore, the reference voltage E may be adjusted to the output voltage of the integrator 31 at the time when the toner in the developing device is consumed and used up.

Figure 8:
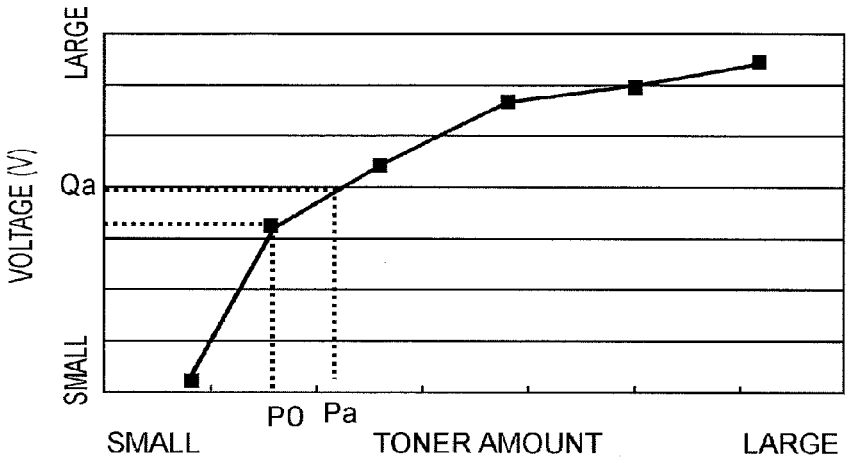
FIG. 8 is a graph showing a relationship between a detected voltage value and a toner amount.

A change of the toner amount in the developing device and the output voltage of the comparator is shown in FIG. 8. The output voltage is decreased with the toner amount. When the toner is further consumed, at a point P0 of the toner amount in the figure, image defect occurs partly on a print image. Then, when the print is further continued, no image is formed at all.

From the above results, in this embodiment, a toner amount Pa obtained by adding a margin, corresponding to 10 sheets of a solid black image, to the toner amount P0 causing the image defect is judged as an amount in which the toner is used up (absent). For this reason, control such that the toner in the developing device is judged to be used up is effected by taking an output voltage Qa as the reference voltage E. In the case where the toner is judged to be used up by the remaining amount detecting means 100*a*, the controller portion 100 executes warning display such as "toner absence" with respect to the developing device. The controller 100 may also be execute control for interrupting the image formation. Further, the controller 100 may notify the operator of exchange timing of the developing device.

Hereinbelow, effects and features of the present invention will be described by using comparative embodiments.

(Comparative Study 1)

A study on the electrostatic capacity depending on a difference in attitude of the developing device during the remaining toner amount detection was made with respect to a single developing device in which a certain amount of toner was filled.

As comparative Embodiment 1, with respect to the developing device at the first position CC which is the position during the development on the drum 1, the electrostatic capacity between the application roller 24 and the developing roller 25 is measured. Next, the developing device is moved to the second position EE by rotating the rotary 50 and the electrostatic capacity between the application roller 24 and the developing roller 25 is measured with respect to the developing device at the second position EE. Then, by repeating the rotation of the rotary 50, the electrostatic capacity between the application roller 24 and the developing roller 25 is repeatedly measured with respect to the developing device at the first position CC and at the second position EE. Incidentally, during this study, the drum 1 has been removed. For this reason, the toner in the developing device does not come out of the developing device, thus being kept at a constant level.

Figure 9:
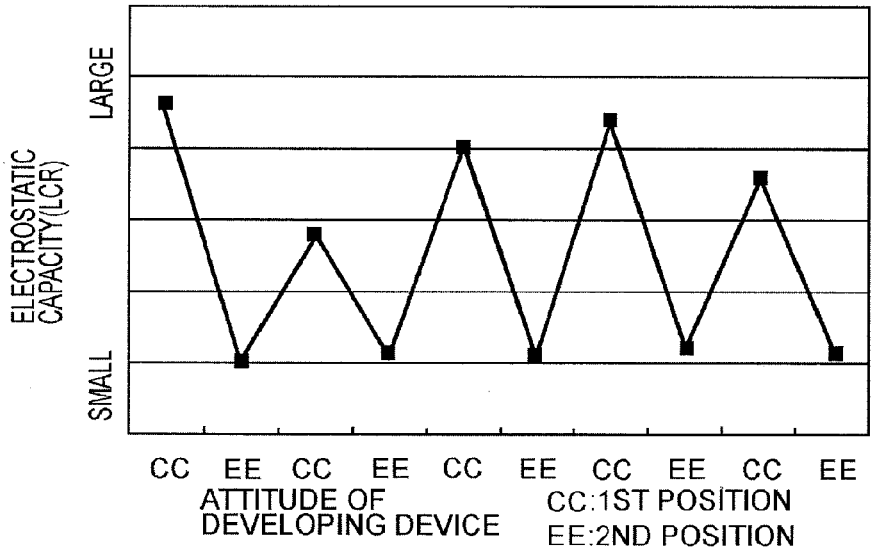
FIG. 9 is a graph showing a result of Comparative Study 1.

The above measurement result is shown in FIG. 9. In FIG. 9, the abscissa represents the attitude of the developing device when the electrostatic capacity is measured and the ordinate represents a detected electrostatic capacity. That is, the attitude of the developing device is the standing attitude for permitting the development at the first position CC as shown in FIG. 2 and is the inverse attitude, in which the developer container is turned upside down, at the second position EE as shown in FIG. 3.

As shown in FIG. 9, the measurement result of the electrostatic capacity at the first position CC varied largely every measurement and a maximum variation was 30%. On the other hand, the measurement result of the electrostatic capacity at the second position EE showed small variation every measurement, so that a variation in electrostatic capacity value was 2% or less.

This is because the toner density in the neighborhood of the application roller 24 in the developer container is changed by the rotation of the rotary 50 at the first position CC as shown in FIG. 2 and due to the influence thereof, an output of the resultant electrostatic capacity is unstable. On the other hand, at the second position EE as shown in FIG. 3, the influence of the toner in the neighborhood of the application roller 24 is eliminated, so that a stable output can be always obtained.

Therefore, by detecting the electrostatic capacity at the second position EE, it is possible to improve accuracy of the remaining toner amount detection.

Incidentally, as shown in FIG. 3, in the neighborhood of an area YY in the developing device at the second position EE in which the remaining toner amount detection is performed, the toner remains in some amount. However, according to the study of the present inventors, the toner amount in the neighborhood of this area YY is constant and is slight compared with the toner amount in the developing device, so that an effect which does not influence the output of the electrostatic capacity is obtained.

(Comparative Study 2)

A study on the difference in attitude of the developing device during the remaining toner amount detection was made with respect to the change in electrostatic capacity before and after standing of the developing device. Incidentally, also in this study, the drum 1 has been removed similarly as in Comparative Study 1, so that the toner amount is kept at a constant level irrespective of the rotation of the rotary 50.

Two developing devices having the same toner filling amount are prepared. Then, as an Embodiment, with respect to one developing device, the rotary 50 is rotated 50 turns to sufficiently loose the toner in the developing device and then is subjected to the measurement of the electrostatic capacity at the second position E. Thereafter, the developing device is left standing for two days. Then, the rotary 50 is rotated 50 turns again and the developing device is subjected to the measurement of the electrostatic capacity at the second position E.

As Comparative Embodiment 2, with respect to the other developing device, the rotary 50 is rotated 50 turns and is subjected to the measurement of the electrostatic capacity at the first position C. Then, the developing device is left standing for two days and is subjected to the measurement of the electrostatic capacity again.

Figure 10:
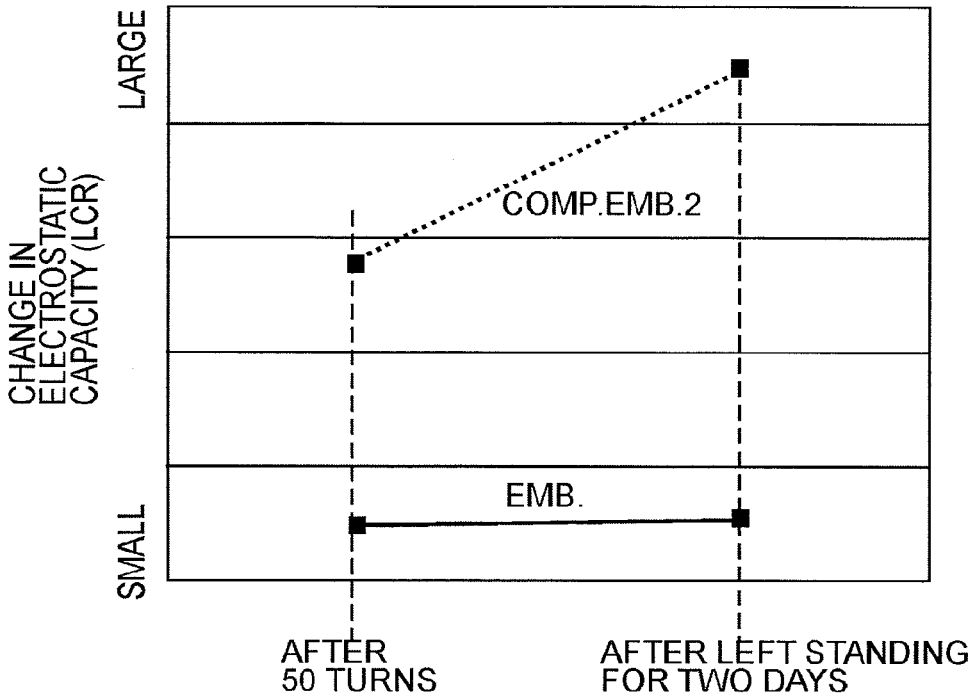
FIG. 10 is a graph showing a result of Comparative Study 2.

A comparison result is shown in FIG. 10. In FIG. 10, a solid line represents the result of Embodiment and a dotted line represents the result of Comparative Embodiment 2. The abscissa represents a detected electrostatic capacity and the ordinate represents measuring timing of the electrostatic capacity.

In Comparative Embodiment 2, although there is no toner consumption in the developing device before and after the developing device standing, it is found that the electrostatic capacity is largely increased after standing. This is a variation corresponding to 45% in the case where a change in electrostatic capacity with respect to the decreased amount of the toner from an initial stage of the use of the developing device to the toner amount Pa in FIG. 8 is taken as 100%. This is because the electrostatic capacity is influenced by the change in density of the toner present around the application roller 24 before and after the standing of the developing device. As a result of standing, the toner in the developer container 21 is densely present around the application roller 24, so that the toner is present in an amount not less than the amount of the toner contained inside the sponge layer. Therefore, the electrostatic capacity is increased.

On the other hand, when the progression of the electrostatic capacity in Embodiment is noticed, it is found that there is no difference in change of the electrostatic capacity between before and after the developing device standing since the electrostatic capacity is measured after the developing device is moved to the second position EE in which the toner present around the application roller 24 is removed with reliability. This is a variation corresponding to 3% in the case where a change in electrostatic capacity with respect to the decreased amount of the toner from the initial stage of the use of the developing device to the toner amount Pa in FIG. 8 is taken as 100%. Thus, even after the developing device is left standing in the state in which the toner is present densely in the neighborhood of the application roller 24, it is possible to obtain a stable measurement result by measuring the electrostatic capacity in such a developing device attitude that the toner in the neighborhood of the application roller 24 is removed.

(Comparative Study 3)

In a conventional constitution, in the case of performing the remaining toner amount detection after the developing device was left standing, it was necessary to stir and circulate the toner in the developing device by driving the developing device in some cases. For this reason, after making the above-described study (Comparative Study 2), the rotation of the rotary 50 is carried out and then the change in electrostatic capacity is measured after the toner is loosened in the following procedure.

1) after one turn of the rotary 50

2) after four turns of the rotary 50

3) after ten turns of the rotary 50

Figure 11:
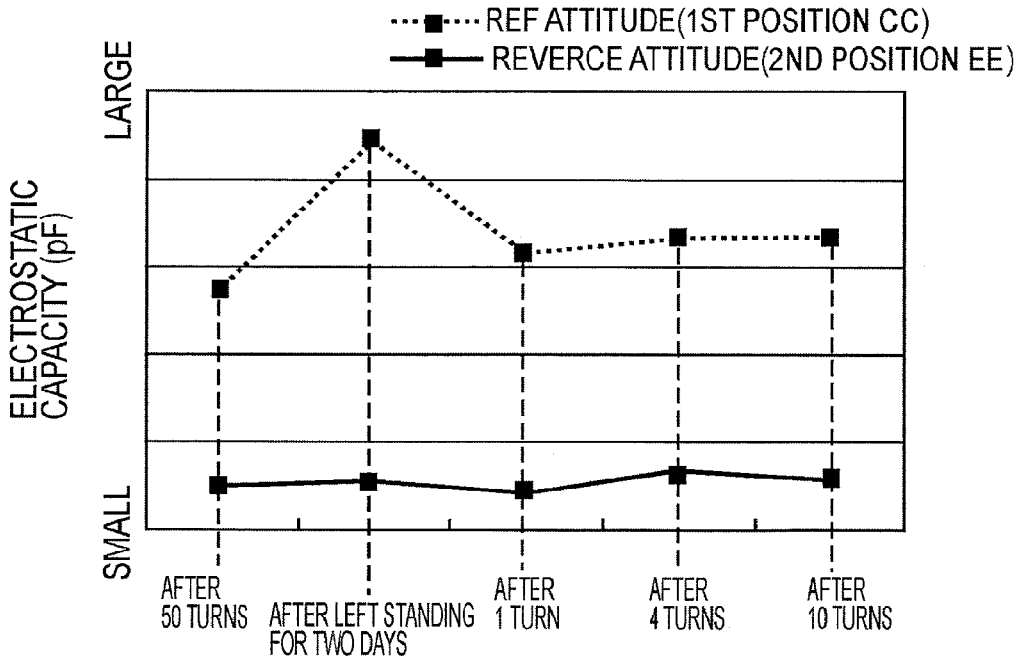
FIG. 11 is a graph showing a result of Comparative Study 3.

The result is shown in FIG. 11. As a comparative embodiment, the case of performing the measurement at the first position CC is indicated by a dotted line. In the comparative embodiment, the electrostatic capacity value was not restored to the output value of the electrostatic capacity in a steady state before the standing even after the stirring of the toner in the developing device by the rotation of the rotary 50 and the toner circulation by the drive of the developing roller and the application roller at the first position CC were performed.

On the other hand, in the case of performing the measurement of the electrostatic capacity at the second position EE in this embodiment indicated by a solid line, it was possible to obtain a stable output of the electrostatic capacity irrespective of the rotation of the rotary 50 and the rotational drive of the application roller 24.

From the above-described results of the Comparative Studies, the image forming apparatus of this embodiment can accurately detect the remaining toner amount in the developer container to notify the user of its information.

Further, according to the image forming apparatus of this embodiment, it is possible to detect the remaining toner amount in another developing device during the image formation. For this reason, there is no need to effect particular control for the remaining toner amount detection, so that it is possible to perform the remaining toner amount detection very efficiently.

Further, the remaining toner amount detection can be performed in a state in which the developing device is at rest, so that it is possible to avoid excessive drive of the developing device for loosening the toner in the developing device as in the conventional constitution.

[Embodiment 2]

The remaining toner amount detection is optimally performed with respect to the developing device in the inverse attitude in which the developer container is turned upside down at the position EE as in Embodiment 1 but can also be performed in the sideways attitudes at the position FF and the position G.

However, in the cases of the position FF and the position G, the developer can contact the application roller 24 at an initial stage of the use of the developing device, so that a stable remaining toner amount detection output cannot be obtained in some cases. However, it is possible to accurately detect the remaining toner amount in the developer container, irrespective of the standing state of the developing device from the time of a decrease of the toner amount in the developing device after the use of the developing device down to an amount at which the toner does not contact the application roller 24, to accurately notify the user of exchange timing.

[Embodiment 3]

Figure 12:
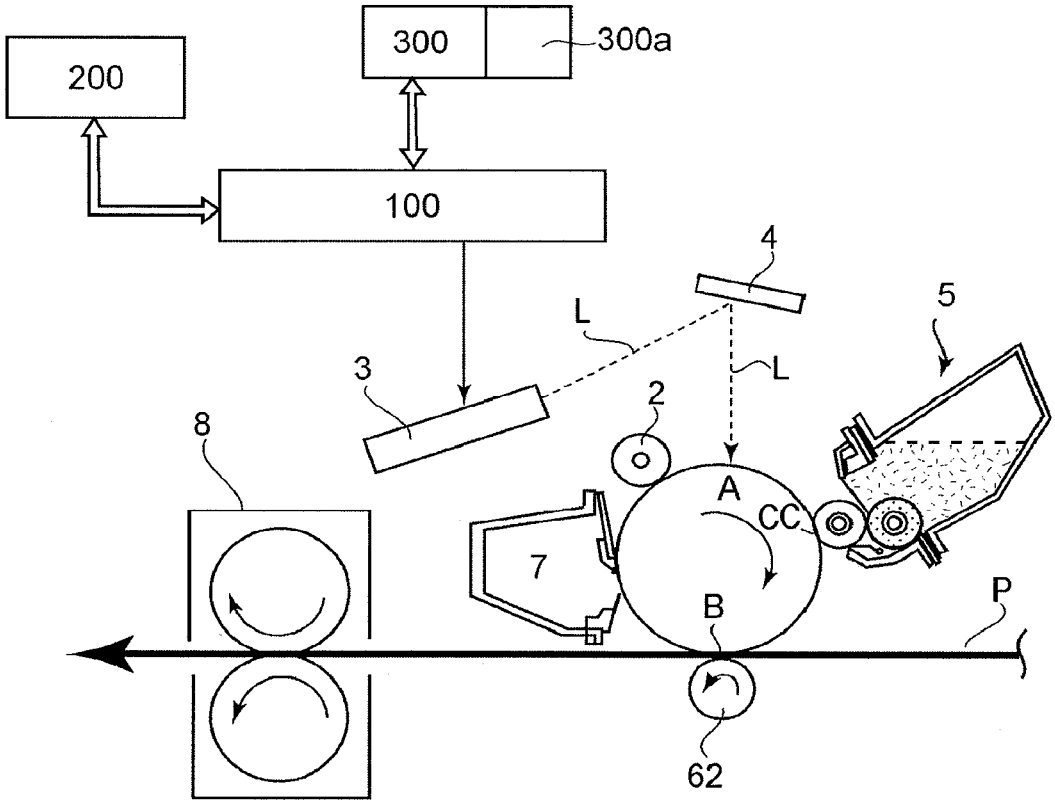
FIG. 12 is a schematic structural view of an image forming apparatus of Embodiment 3.

FIG. 12 is a schematic structural view of an image forming apparatus in Embodiment 3. This image forming apparatus is a single-color (monochromatic) image forming apparatus using the electrophotographic process. Constitutional members or portions common to those for the image forming apparatus of Embodiment 1 are represented by the same reference numerals or symbols, thus being omitted from redundant explanation. In this image forming apparatus, the peripheral surface of the electrophotographic photosensitive drum 1 rotationally driven in the clockwise direction indicated by an arrow is electrically charged uniformly by the charging roller 2. The charged surface of the drum 1 is subjected to scanning exposure with the laser light L modulated correspondingly to the image information by the laser scanner unit 3 and the reflection mirror 4. As a result, the electrostatic latent image is formed on the drum surface. The electrostatic latent image is developed into the toner image. The formed toner image is transferred onto the recording material P fed from the sheet feeding portion (not shown) to the transfer nip B, between the drum 1 and the transfer roller 62, with the predetermined control timing.

The recording material P coming cut of the transfer nip B is separated from the surface of the drum 1 and guided into a fixing unit 8, in which the recording material P is heated and pressed in a fixing nip. As a result, the toner image is fixed on the recording material P. Then, the recording material P comes out of the fixing unit 8 and is discharged to a sheet discharge portion (not shown) as a single color image-formed product.

Transfer residual toner remaining on the surface of the drum 1 after the separation of the recording material P is removed by the drum cleaning means 7.

Figure 13:
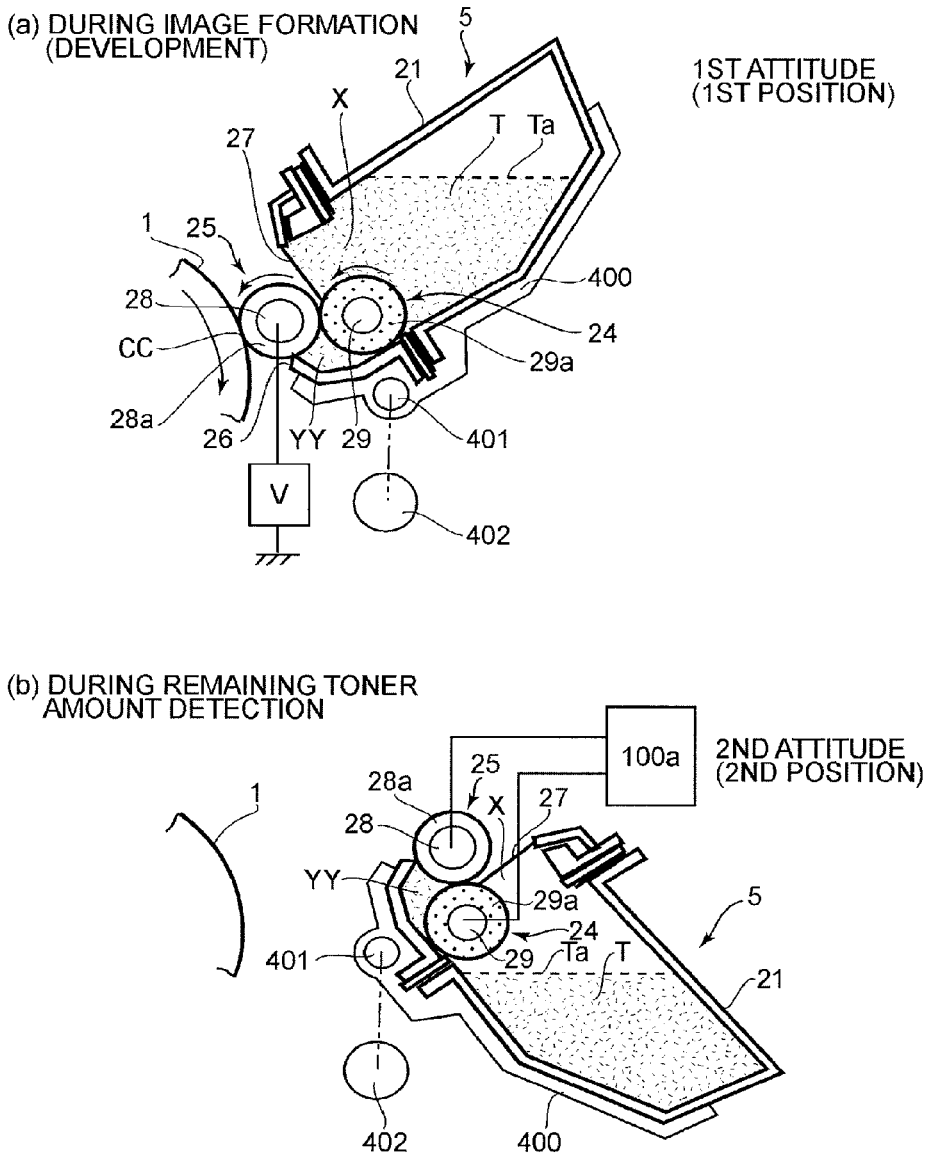
FIGS. 13(*a*) and 13(*b*) are schematic views of the developing device, wherein FIG. 13(*a*) shows a first attitude (position) and FIG. 13(*b*) shows a second attitude (position).

FIG. 13(*a*) is an enlarged view of the developing device 5 portion of the image forming apparatus shown in FIG. 12. This developing device 5 includes, similarly as the developing device in Embodiment 1, the developer container 21 as the developer accommodating chamber in which non-magnetic toner as the developer T is accommodated. Further, the developing device 5 includes the developing roller 25 as the developer carrying member for developing the electrostatic latent image formed on the drum 1, and the application roller 24 as the developer feeding member for feeding the toner in contact with the developing roller 25. The developing device 5 further includes a regulating blade 27 as a developer layer thickness regulating member for regulating the thickness of the toner layer on the developing roller 25 and a leak prevention seal 26 for preventing the toner from leaking out of a gap between the developing roller 25 and the developer container 21.

The developing device 5 is detachably mounted to the mounting table 400 on the image forming apparatus main assembly side. This mounting table 400 is used as a switching means for switching the attitude of the developing device 5 to the first attitude (the first position) shown in FIG. 13(*a*) and the second attitude (the second position) shown in FIG. 13(*b*) and is swung about a shaft portion 401 by a driving means 402 controlled by the controller portion 100. As the driving means, it is possible to use, e.g., a gear mechanism using a forward reverse motor, an electromagnetic solenoid mechanism, a rack-and-pinion mechanism, etc.

The first attitude of the developing device 5 shown in FIG. 13(*a*) is the attitude in which the toner T in the developer container 21 is feedable to the application roller 24. That is, the first attitude is the developable attitude in which the toner T is present in the area X from the nip between the developing roller 25 and the application roller 24 to a portion located upstream of the nip with respect to the rotational direction of the application roller 24.

The second attitude of the developing device 5 shown in FIG. 13(*b*) is the attitude in which the toner T is returned from the application roller 24 to the developer container 21. That is, the second attitude is the attitude in which the toner T in the area X from the nip between the developing roller 25 and the application roller 24 to the portion upstream of the nip with respect to the rotational direction of the application roller 24.

The controller portion 100 swing-controls the mounting table 400 so as to hold the developing device 5 in the first attitude during the image formation as shown in FIG. 13(*a*). The developing roller 25 of this developing device 5 contacts the drum 1. The developing roller 25 develops the electrostatic latent image formed on the drum 1 in the contact state with the drum 1. That is, a so-called contact developing system is employed.

Into the developing device 5 in the first attitude, the driving force and the developing bias are inputted from the driving means (not shown) and a power source portion V, respectively, on the image forming apparatus main assembly side during execution of the image formation.

After the image formation, the controller portion 100 swing-controls the mounting table 400 so as to hold the developing device 5 in the second attitude shown in FIG. 13(*b*). Then, the remaining toner amount detection by the remaining amount detecting means 100*a* is performed with respect to the developing device 5 held in the second attitude.

Also in the thus-constituted image forming apparatus, irrespective of the standing state of the developing device 5, it is possible to accurately detect the remaining toner amount in the developer container to notify the use of its information.

(Other Embodiments)

1) The image forming apparatus is not limited to that of the electrophotographic type. The image forming apparatus may also be an electrostatic recording type image forming apparatus using an electrostatic recording dielectric member as the image bearing member or a magnetic recording type image forming apparatus using a magnetic recording magnetic material as the image bearing member.

2) Further, the developing means 5 may also be a non-contact type developing device using the non-magnetic toner as the developer and a contact or non-contact type developing device using the magnetic toner as the developer.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 161528/2008 filed Jun. 20, 2008 and 112020/2009 filed May 1, 2009, which is hereby incorporated by reference.

What is claimed is:

1. An image forming apparatus comprising:

an image bearing member for bearing an electrostatic latent image at a surface thereof;

a developing device for developing the electrostatic latent image, said developing device including:

a developer accommodating chamber for accommodating developer used for developing the electrostatic latent image, a developer carrying member for developing the electrostatic latent image by feeding the developer to said image bearing member, and a developer feeding member which is contactable to said developer carrying member to feed the developer to said developer carrying member and which has a foam layer at a surface thereof;

a holding unit for holding said developing device, wherein said holding unit is capable of changing a position of said developing device to a first position in which said developing device takes a developable attitude and to a second position in which said developing device takes an attitude in which the developer having been located above a nip between said developer carrying member and said developer feeding member in the first position drops from the nip; and a detecting device for detecting electrostatic capacity generated between a metal core of said developer feeding member and a metal core of said developer carrying member, said detecting device detecting the electrostatic capacity at the second position.

2. An apparatus according to claim 1, wherein at the second position, a surface of the developer accommodated in said developer accommodating chamber is out of contact with said developer feeding member.

3. An apparatus according to claim 1, wherein said foam layer is an open-cell member.

4. An apparatus according to claim 1, wherein said developing device further includes a plurality of developing device portions mounted to predetermined mounting portions of said holding unit having a plurality of developing device mounting portions.

* * * * *